US009428003B2

(12) United States Patent
Gill, Jr.

(10) Patent No.: US 9,428,003 B2
(45) Date of Patent: Aug. 30, 2016

(54) MOUNTING BRACKET

(71) Applicant: Gene L. Gill, Jr., Granby, CT (US)

(72) Inventor: Gene L. Gill, Jr., Granby, CT (US)

( * ) Notice: Subject to any disclaimer, the term of this patent is extended or adjusted under 35 U.S.C. 154(b) by 130 days.

(21) Appl. No.: 14/223,141

(22) Filed: Mar. 24, 2014

(65) Prior Publication Data

US 2015/0083874 A1 Mar. 26, 2015

Related U.S. Application Data

(60) Provisional application No. 61/881,115, filed on Sep. 23, 2013.

(51) Int. Cl.
*A47F 5/00* (2006.01)
*B44C 5/02* (2006.01)

(52) U.S. Cl.
CPC ..... *B44C 5/02* (2013.01)

(58) Field of Classification Search
USPC ..... 248/222.14, 301, 304; 211/106.01
See application file for complete search history.

(56) References Cited

U.S. PATENT DOCUMENTS

| | | | | |
|---|---|---|---|---|
| 7,284,671 | B1 * | 10/2007 | Doscher | A63B 71/0036 211/106.01 |
| 8,157,234 | B2 * | 4/2012 | Powell | A41G 1/009 248/309.1 |
| D736,579 | S * | 8/2015 | Hauser | D8/34 |
| 2006/0154224 | A1 * | 7/2006 | St.Ama | G09B 23/36 434/296 |
| 2012/0181244 | A1 * | 7/2012 | Wang | A47G 25/0614 211/106.01 |
| 2014/0209768 | A1 * | 7/2014 | Maria | B44C 5/02 248/222.14 |

* cited by examiner

*Primary Examiner* — Steven Marsh
(74) *Attorney, Agent, or Firm* — Cantor Colburn LLP

(57) ABSTRACT

Disclosed is an apparatus for mounting vertebrate skulls using a skull foramen magnum cavity and a skull cleft, the apparatus including a body; an at least one upper tine extending from said body and being configured for insertion into the skull foramen magnum cavity; and an at least one lower tine extending from said body and being configured to nest within the skull cleft when said at least one upper tine is inserted into the foramen magnum cavity.

15 Claims, 3 Drawing Sheets

MOUNTING BRACKET

CROSS REFERENCE TO RELATED APPLICATIONS

This application claims the benefit of U.S. Provisional Patent Application 61/881,115 filed on Sep. 23, 2013, of which said application is herein incorporated by reference in its entirety.

FIELD

The disclosure relates generally to apparatuses and methods to mount and display skulls, particularly the skulls of game animals.

BACKGROUND

Conventional devices to mount and display skulls of game animals require physically attaching the skull to a mounting apparatus by means such as screws, glue, staples, or nails. Certain conventional devices may display the skull in an unnatural position and may not offer adjustability. Further, conventional devices may require some damage or modification to the skull to secure the skull to the mount, diminishing the value of the skull.

Accordingly, a mounting bracket that allows the skull to be displayed without damaging the skull, while offering adjustability would be desirable.

SUMMARY

Disclosed is an apparatus for mounting vertebrate skulls using a skull foramen magnum cavity and a skull cleft, the apparatus including a body; an at least one upper tine extending from said body and being configured for insertion into the skull foramen magnum cavity; and an at least one lower tine extending from said body and being configured to nest within the skull cleft when said at least one upper tine is inserted into the foramen magnum cavity.

Further disclosed is an apparatus for mounting skulls, said apparatus including a body with a hole formed therein; an at least one upper tine extending upwardly from said body; an at least one lower tine disposed between said plurality of upper tines, wherein said at least one lower tine is extending downwardly from said body; and a mount for anchoring said apparatus, said mount configured to allow said at least one upper tine and said at least one lower tine to move relative to said mount, said mount including an anchor body with a threaded hole therethrough; and a fastener to retain said body and is threadedly coupled to threaded hole.

BRIEF DESCRIPTION OF THE FIGURES

The accompanying drawings incorporated in and forming a part of the specification embodies several aspects of the present invention and, together with the description, serve to explain the principles of the invention. In the drawings.

DETAILED DESCRIPTION

Figure 1:
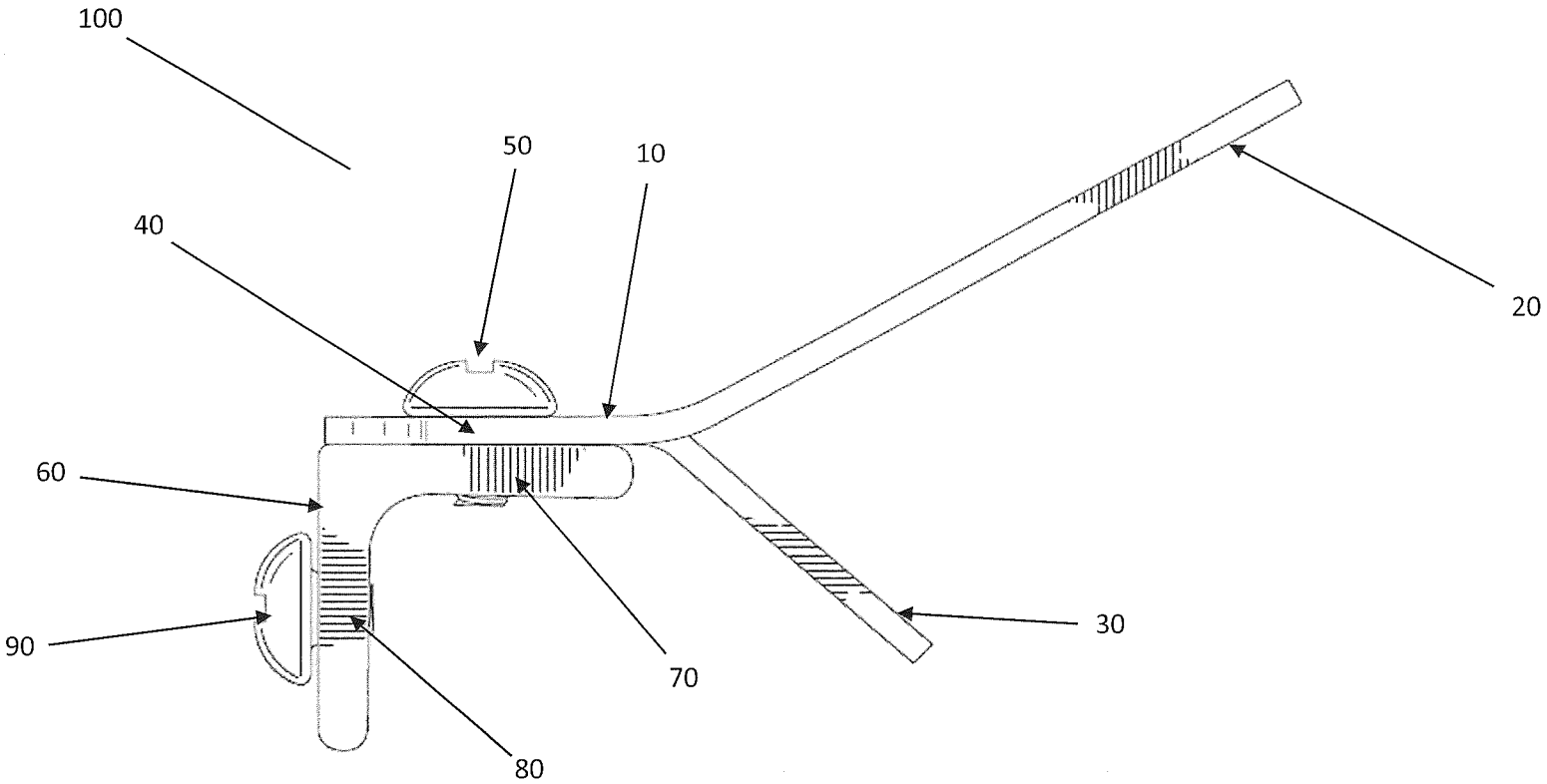
FIG. 1 is an elevation view of a mounting bracket in accordance with an exemplary embodiment.

The following disclosure will detail particular embodiments according to the present invention, which provides methods and apparatuses for mounting skulls. Before discussing the methods and apparatuses however, a general description of European Mounts and of the relevant anatomy of skulls, particularly game animal skulls is provided immediately below.

A game skull may be displayed as a European Mount. European Mounts have little to no animal flesh, animal hide or internal parts to maintain. In a European Mount, only the skull, horns and/or antlers are displayed. As a result, natural features, bones, and cavities of a skull may be used to mount the skull for display. European Mounts may be considered for their ease of maintenance, distinctive appearance and affordability.

Reference is now made to the drawings, wherein like reference numerals are used to refer to like elements throughout the disclosure.

Figure 3:
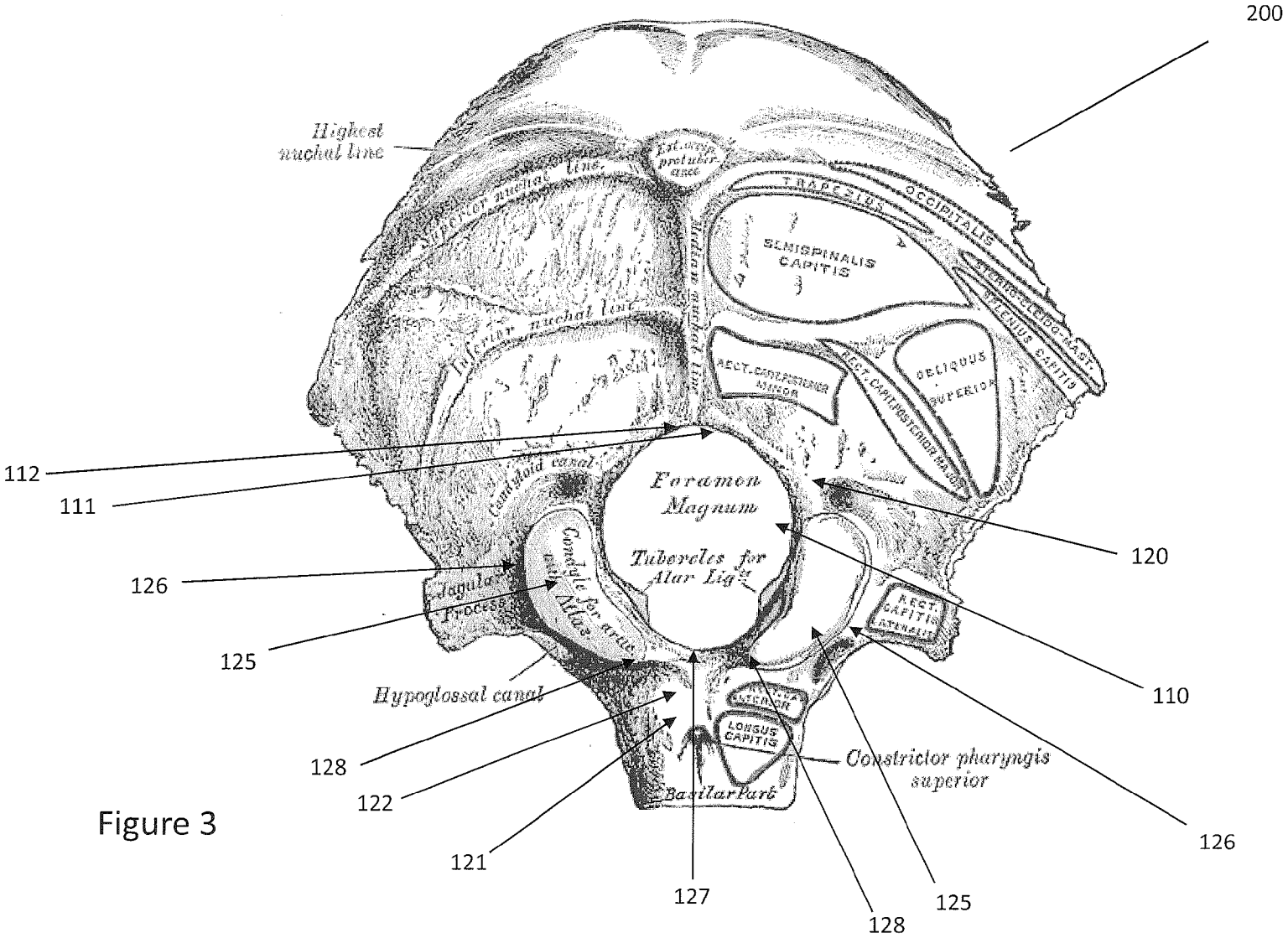
FIG. 3 is an anterior posterior view of a skull of a vertebrate animal.

As shown in FIG. 3, the skull 200 is formed of several bones that fuse together to form a protective shell for the brain. Skulls of vertebrate animals, including game animals have a natural hole known as the foramen magnum 110. The foramen magnum 110 is a natural cavity that runs through the occipital bone 120 of the skull 200. The foramen magnum 110 is the animal's natural conduit for the nerves and arteries to the brain from the rest of the animal's body. Typically in vertebrate animals, the skull 200 sits upon the top vertebrae and the brain is connected to various parts of the body by nerves that run from the brain and transmit impulses through the body via the vertebrae that run down the animal's body. The skull 200 is typically arranged such that the foramen magnum 110 is lined up axially in the center of the skull 200 and positioned at the anterior portion of the skull 200 or alternatively stated, the bottom of the skull 200 when the animal is upright. The foramen magnum 110 cavity exposes the supraoccipital bone 111 and the squamous portion 112 of the occipital bone of the skull 200.

Another natural feature of skulls 200 belonging to vertebrate animals is the bony ridge called the occipital condyles 125. The occipital condyles 125 are located on the occipital bone 120, known specifically as the basiocciput 121 or alternatively the posterior clivus 122. The occipital condyles 125 are positioned on the left and right side of the foramen magnum 110. The outside edges of the occipital condyles 125 form natural crevices 126, which allow for articulation between the upper vertebrae and the skull 200. The upper vertebrate has lateral masses (not shown) that pivot and are captured in the natural crevices 126 of the occipital condyles 125 when the animal is lifting and rotating its head. Further, the inner portions 128 of the occipital condyles 125 along with the basiocciput 121 or the posterior clivus 122 form a cleft 127 anterior of the foramen magnum 110.

Having discussed the relevant anatomy of skulls generally, further detail regarding a mounting bracket for skulls will now be discussed hereinbelow.

Figure 2:
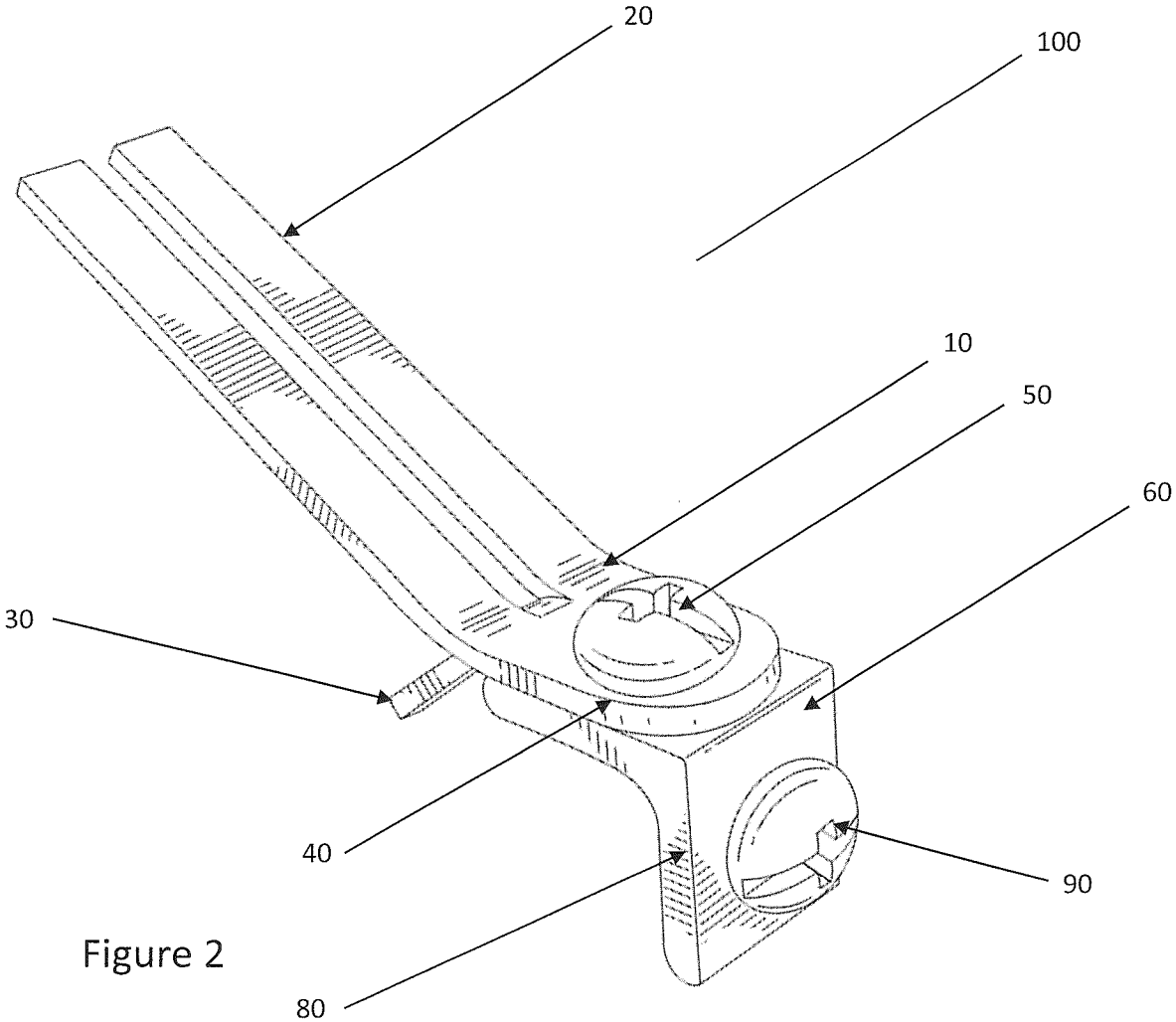
FIG. 2 is a partial perspective view of a mounting bracket such as that shown in FIG. 1.

Referring to FIGS. 1 and 2, an exemplary embodiment of a mounting bracket 100 for mounting and displaying a skull is illustrated. The mounting bracket 100 includes a body 10 with upper tines 20 and lower tines 30 extending therefrom. In an exemplary embodiment, the body 10 is adjustably coupled to an anchor body 60. Anchor body 60 may be coupled to a wall or other support structure.

As shown in FIGS. 1 and 2, body 10 has a generally horizontal orientation and at least one planar portion. Further, upper tines 20 and lower tines 30 extend from body 10. In at least one exemplary embodiment, the overall length of body 10, upper tines 20, and lower tines 30 is three inches. In alternative embodiments, the overall length of the body 10, upper tines 20, and lower tines 30 are any suitable length.

In an exemplary embodiment, body 10 has an aperture 40 formed therein to allow for a fastener, such as set screw 50 to pass therein and allow for rotational adjustment relative to anchor body 60. Accordingly, the edges of body 10 may be rounded to remove any corners or other obstacles to allow for rotation of mounting bracket 100 when mounting bracket 100 is located near a mounting surface where corners of mounting bracket 100 or body 10 may impede rotation. Similarly, body 10 may be otherwise finished to remove sharp edges and to increase aesthetic appeal.

Body 10 further includes upper tines 20 that extend upwardly from body 10. Body 10 may include one or more upper tines 20. In at least one exemplary embodiment, mounting bracket 100 contain two upper tines 20. The upper tines 20 are in a generally parallel arrangement relative to other upper tines 20. For ease of manufacturing, it may be contemplated to space the upper tines 20 a distance apart that is greater than or equal to the width of the lower tine 30. Accordingly, in an exemplary embodiment, upper tines 20 and lower tines 30 are formed during a single metal stamping, cutting, or other general forming operation. In other embodiments, the body 10, upper tines 20, and the lower tines 30 are separate elements that are discretely formed.

Relative to body 10, the upper tines 20 may extend at an obtuse angle upwardly. In certain embodiments, the upper tines 20 extend upwardly at an angle between 30-40 degrees relative to body 10. In other embodiments, the upper tines 20 extend upwardly at an angle between 32.5-37.5 degrees relative to body 10. However, in other embodiments, the upper tines 20 extend at any angle suitable to mount and display a skull. Upper tines 20 may be of any length suitable for insertion into the foramen magnum cavity 110 (as shown in FIG. 3). In at least one exemplary embodiment, upper tines 20 are 2.25 inches long. Further, in an exemplary embodiment, the upper tines 20 are configured to enter the foramen magnum cavity 110 of a skull 200. Additionally, the upper tines 20 may contact the bones found inside the foramen magnum cavity 110, such as the supraoccipital bones 111 or the squamous portion 112 of the occipital bone 120 found within the cavity 110. Accordingly, it is contemplated for the upper tines 20 to support the weight of a skull and assist in keeping the skull at the desired angle.

In addition to upper tines 20, body 10 includes lower tines 30 that extend downwardly from body 10. In an exemplary embodiment, lower tines 30 may be disposed between a plurality of upper tines 20. Lower tines 30 may include one or more lower tines 30. In at least one exemplary embodiment, mounting bracket 100 contains one lower tine 30. As previously contemplated, lower tine 30 may be formed by cutting, bending, punching or otherwise forming the material between upper tines 20 downward. In other embodiments, the lower tine 30 is a discrete element as previously contemplated.

Relative to body 10, the lower tine 30 may extend at an obtuse angle downwardly. In certain embodiments, the lower tine 30 extends downwardly at an angle between 30-40 degrees relative to body 10. In other embodiments, the lower tine 30 extends downwardly at an angle between 32.5-37.5 degrees relative to body 10. However, in other embodiments, the lower tine 30 extends at any angle suitable to mount and display a skull. Similarly, the overall angle between the lower tine 30 and the upper tines 20 is between 65 to 75 degrees. In other embodiments, the overall angle between the lower tine 30 and the upper tines 20 may be between 67.5 to 72.5 degrees. However, in other embodiments, the overall angle between the lower tine 30 and the upper tines 20 is any angle suitable to mount and display a skull. Lower tine 30 may be of any length suitable for mounting and displaying skulls. In at least one embodiment, lower tine 30 is ⅞ inches long. In at least one embodiment, the lower tine 30 is substantially thinner than the upper tines 20. In an exemplary embodiment, the lower tine 30 is configured to rest or nest in the cleft 127 defined between the occipital condyles 125 of a skull 200, on the basiocciput 121, also referred to as posterior clivus 122, to support, stabilize and prevent side to side rotation of a skull 200 by interfacing with the lower tine 30 (as shown in FIG. 3).

Body 10 including, upper tines 20, and lower tines 30 may be formed from a single piece of material. In at least one embodiment, body 10, upper tines 20, and lower tines 30 are cut, formed, and shaped from sheet metal. In at least one exemplary embodiment, the sheet metal is 14 gauge steel. In alternative embodiments, the thickness of the steel varies depending on the load requirements of the mounting bracket. Accordingly, in an embodiment where heavier loads are anticipated, the sheet metal is 12 gauge or thicker. Additionally, mounting bracket 100 may be finished for aesthetic and functional purposes. In alternative embodiments, body 10, upper tines 20, and lower tines 30 are formed from discrete elements. In at least one embodiment, the mounting bracket 100 may be anodized.

Anchor body 60 may be utilized to couple body 10 with a desired mounting surface with the use of an appropriate fastener. In at least one exemplary embodiment, anchor body 60 has two planar surfaces in a perpendicular relationship with each other. Anchor body 60 may be made of angle iron. Further, anchor body 60 may be expanded or elongated for larger skulls or skulls with larger or curved horns, to allow for more distance from the mounting surface.

In at least one embodiment, anchor body 60 has a threaded hole 70 located on the top portion of the anchor body 60 to receive a fastener such as set screw 50, in order to couple anchor body 60 to body 10. Further, in at least one embodiment, anchor body 60 may have a second threaded hole 80 to receive a fastener such as mounting screw 90, in order to couple anchor body 60 to a suitable mounting surface.

Set screw 50 is threadedly coupled to hole 70 in anchor body 60, and further serves to adjustably couple body 10 to anchor body 60. In an exemplary embodiment, body 10, along with upper tines 20 and lower tines 30 are able to be rotated left to right relative to anchor body 60, along the axis created by set screw 50 when threadedly coupled into threaded hole 70. Accordingly, the left to right rotation of body 10 and the skull 200 attached thereto can be adjusted, and set screw 50 may be tightened to couple body 10 to anchor body 60 and maintain the desired rotational position.

In an exemplary embodiment, mounting screw 90 interfaces with a mounting surface to threadedly couple threaded hole 80 and anchor body 60 to the mounting surface. Additionally, the thickness of the mounting surface may require a longer mounting screw which may be used accordingly. Further, a wood screw may be contemplated to mount anchor body 60.

An exemplary embodiment of a process for mounting and displaying a skull will now be described in detail. Importantly, steps may be skipped or combined in various embodiments.

First, the anchor body and body assembly may be mounted to a suitable mounting surface via a mounting screw. As previously contemplated, a suitable mounting screw may be used for a mounting surface of a certain thickness. Alternatively, a wood screw may be used to mount the anchor body and body to a mounting surface as well.

Next, the upper tines are positioned into the natural cavity of a suitable skull. Specifically, the upper tines are positioned into the foramen magnum 110 of the skull 200. As previously discussed, the skull 200 now rests on the inner portion of the foramen magnum 110, known as the supraoccipital bones 111 or the squamous portion 112 of the occipital bones 120.

Next, the lower tines are positioned into the natural cleft 127 of the skull 200, located adjacent to the natural cavity, specifically the foramen magnum 110 present in the skull 200. As previously discussed, a natural cleft 127 is created between the occipital condyles 125, wherein the lower tines may rest on the basiocciput 121, also referred to as posterior clivus 122.

Lastly, the body of the mounting bracket may be rotated relative to the anchor body and the mounting surface, by loosening the set screw and rotating the skull and the corresponding mount body relative to the anchor body and the mounting surface. Once a desired orientation is achieved, the set screw can be tightened to secure the proper orientation.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments of this invention are described herein, including the best mode known to the inventors for carrying out the invention. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for mounting vertebrate skulls using a skull foramen magnum cavity and a skull cleft, the apparatus comprising:

a body;

an at least one upper tine extending from said body at an upward obtuse angle and being configured for insertion into the skull foramen magnum cavity; and an at least one lower tine extending from said body at a downward obtuse angle and being configured to nest within the skull cleft when said at least one upper tine is inserted into the foramen magnum cavity, wherein an overall angle between the at least one upper tine and the at least one lower tine is between 65 degrees and 75 degrees.

2. The apparatus of claim 1, wherein said at least one upper tine is a plurality of upper tines in parallel orientation.

3. The apparatus of claim 2, wherein said plurality of upper tines are spaced apart a distance greater than or equal to a width of said at least one lower tine.

4. The apparatus of claim 3, wherein said at least one lower tine is disposed between said plurality of upper tines.

5. The apparatus of claim 1, wherein said at least one upper tine is disposed at an angle relative to said body and said at least one lower tine to allow said at least one lower tine to nest with the skull cleft.

6. The apparatus of claim 1, further comprising a hole formed through said body and a mount for anchoring said apparatus, said mount configured to allow said at least one upper tine and said at least one lower tine to move relative to said mount, said mount comprising:

an anchor body with a threaded hole therethrough;

a fastener configured to retain said body via said hole and is threadedly coupled to said threaded hole.

7. The apparatus of claim 6, wherein said fastener is configured to adjust a relative rotation of said body and said anchor body.

8. The apparatus of claim 6, wherein a second threaded hole is formed through said anchor body, and is configured to receive a second fastener that is threadedly coupled to said second threaded hole.

9. The apparatus of claim 8, wherein a plane of said threaded hole and a second plane of said second threaded hole are disposed perpendicular to each other.

10. An apparatus for mounting skulls, said apparatus comprising:

a body with a hole formed therein;

an at least one upper tine extending upwardly from said body at an upward obtuse angle;

an at least one lower tine disposed between said plurality of upper tines, wherein said at least one lower tine is extending downwardly from said body at a downward obtuse angle, wherein an overall angle between the at least one upper tine and the at least one lower tine is between 65 degrees and 75 degrees; and a mount for anchoring said apparatus, said mount configured to allow said at least one upper tine and said at least one lower tine to move relative to said mount, said mount comprising:

an anchor body with a threaded hole therethrough; and a fastener to retain said body and is threadedly coupled to threaded hole.

11. The apparatus of claim 10, wherein said at least one upper tine is a plurality of upper tines in parallel orientation.

12. The apparatus of claim 11, wherein said plurality of upper tines are spaced apart a distance greater than or equal to a width of said at least one lower tine.

13. The apparatus of claim 10, wherein said fastener is configured to adjust a relative rotation of said body and said anchor body.

14. The apparatus of claim 10, wherein a second threaded hole is formed through said anchor body, and is configured to receive a second fastener that is threadedly coupled to said second threaded hole.

15. The apparatus of claim 10, wherein a plane of said threaded hole and a second plane of said second threaded hole are disposed perpendicular to each other.

* * * * *